United States Patent [19]

Margolies

[11] Patent Number: 4,798,262

[45] Date of Patent: Jan. 17, 1989

[54] TRIPODAL SUPPORT

[76] Inventor: Paul Margolies, 1350 Spanish River Rd., Boca Raton, Fla. 33432

[21] Appl. No.: 906,719

[22] Filed: Sep. 12, 1986

[51] Int. Cl.[4] ..... E06C 1/14; E06C 1/383; E06C 7/18

[52] U.S. Cl. ..... 182/106; 182/107; 182/169; 182/172

[58] Field of Search ..... 182/169, 172, 173, 174, 182/106, 107; 248/188.5

[56] References Cited

U.S. PATENT DOCUMENTS

| | | | |
|---|---|---|---|
| 5,451 | 6/1873 | Hays | 182/172 |
| 361,212 | 4/1887 | Dormitzer | 182/106 |
| 1,045,358 | 11/1912 | Aragall | 248/188.5 |
| 1,385,319 | 7/1921 | Enke | 182/169 |
| 2,010,588 | 8/1935 | Gooden | 182/106 |
| 2,167,157 | 7/1939 | Muehlberg | 182/106 |
| 2,614,744 | 10/1952 | Hedglon | 182/106 |
| 2,640,641 | 6/1953 | Tepper | 182/106 |
| 2,656,088 | 10/1953 | White | 182/106 |
| 3,508,628 | 4/1970 | Conrad | 182/172 |
| 3,856,112 | 12/1974 | Stewart | 182/106 |
| 4,011,926 | 3/1977 | Larson | 182/172 |

FOREIGN PATENT DOCUMENTS

| | | | |
|---|---|---|---|
| 1053800 | 10/1953 | France | 182/169 |
| 116778 | 2/1927 | Switzerland | 182/169 |
| 126810 | 5/1919 | United Kingdom | 182/106 |

*Primary Examiner*—Reinaldo P. Machado
*Attorney, Agent, or Firm*—Malin, Haley & McHale

[57] ABSTRACT

This invention relates to tripodal support structures and more particularly to a three-legged folding step-ladder having outrigger-type support extensions on the two front support legs, a rear support member having a single ground contact point, and independently extendable and retractable safety hand rails. The support legs of the instant invention contact the ground at points spaced apart from one another to form an equilateral triangle when viewed from above.

7 Claims, 3 Drawing Sheets

TRIPODAL SUPPORT

BACKGROUND OF THE INVENTION

1. Field of the Invention

This invention relates to tripodal support structures and more particularly to a three-legged folding step-ladder having outrigger-type support extensions on the two front support legs, a rear support member having a single ground contact point, and independently extendable and retractable safety hand rails. The support legs of the instant invention contact the ground at points spaced apart from one another to form an equilateral triangle when viewed from above.

2. Description of the Prior Art

Four-point support configurations, as are universally found with stepladders, are inherently unstable against lateral tilting, due to the relatively large ratio of ladder height to width. As a user climbs higher, this instability increases due to the increase in the moment arm as measured between the ladder/ground support points and the user's body. The inherent statical indeterminacy of this configuration often results in serious injuries to users, and the risk of accident increases with the height of climb.

It is widely known that a three-point support configuration is more stable against a lateral force input than a four-point configuration, and that an equilateral support configuration provides optimal stability. For example, a surveyor's instrument, which requires near absolute rigidity for accurate performance, depends on a tripod for support. Numerous attempts have been made to provide additional lateral support to step or other ladders, but none have incorporated an equilateral tripodal support design, together with retractable safety handrails connected to the side rails of the ladder. The concepts embodied in the following list of U.S. Pats. Nos. are representative of past efforts: 479,051, 1,333,344, 4,011,926, 952,836, 1,342,881, 4,147,231, 1,134,437, 3,856,112, 4,293,055, 1,217,713, 3,891,054, 4,519,477.

SUMMARY OF THE INVENTION

In accordance with the present invention, there is shown and described a tripodal support structure in the form of a three legged ladder comprised of a pair of parallel elongated side rails connected by a series of generally horizontally disposed ladder rungs or steps, and a single-footed rear support connected to a top rung or platform. Near the lower end portions of each of said side rails are provided swingingly extendable and retractable lateral support legs (outriggers) with lower ends having foot support means connected thereto. Said support legs (outriggers) extend below the bottoms of the side rails and are configured in such a way that, when extended, the foot support means contact the ground at a distance apart of approximately 60% of the vertical height of the ladder; i.e., for an eight-foot ladder, the front feet would contact the ground approximately five feet apart. The rear support leg is so configured that, in its extended position, its foot contacts the ground at a point equidistant from each of the front feet, and forms the apex of an equilateral triangle when view from above. In this way the ladder support points form a broad base relative to ladder height, thereby substantially increasing the stability of the ladder.

The upper end portion of the rear support leg in its extended position (e.g. in-use position) contacts the side rail/rung combination, or ladder section, in leaning fashion. It can be seen, when viewed from the top and side of the ladder, that as a user climbs higher, he moves increasingly closer to being centered over the triangular base, the most stable position.

The instant invention also employs the use of a pair of individually extendable, adjustable and retractable side hand rails, one slidably connected to each side rail and extendable, preferably, to a height of 3'-6" above the topmost rung, or top platform, of the ladder so that a user can steady himself with one hand while working with the other hand even when said user is positioned on the topmost rung. Most step-ladders have side rails which converge toward each other from bottom to top when viewed from the front of the ladder. Useful handrails cannot be employed thereon because when extended they would converge into the space the user would occupy. The present invention utilizes parallel side rails to overcome this problem.

It is an object of the present invention to provide a simple tripodal support ladder arrangement.

It is another object of the present invention to provide a three-point support system in the form of a foldable ladder with extendable outrigger type support legs forming two of the support points connected one to each front ladder leg and further having a single rear support leg forming the third support point.

It is still a further object of the present invention to provide a three-legged ladder which is equally stable in every lateral direction.

It is another object of the present invention to provide a tripodal support ladder having independently extendable, adjustable and retractable safety hand rails.

In accordance with these and other objects which will be apparent hereinafter, the instant invention will now be described with particular reference to the accompanying drawings.

DETAILED DESCRIPTION OF THE PREFERRED EMBODIMENT

Figure 1:
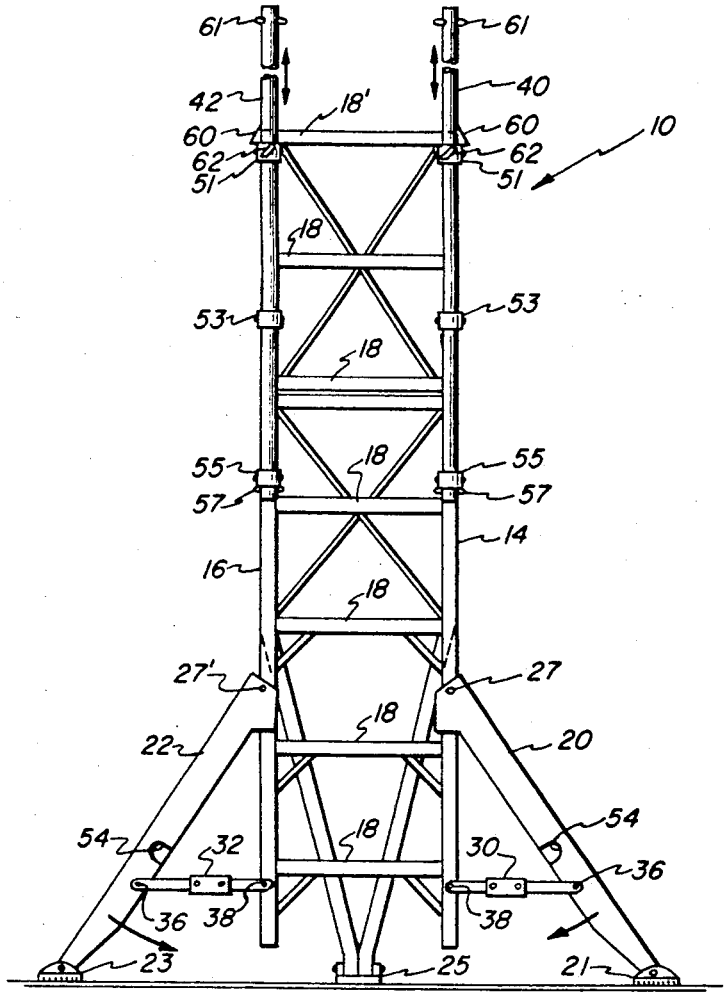
FIG. 1 is a front view of the invention with the safety hand rails and the support legs in the extended position.
Figure 2:
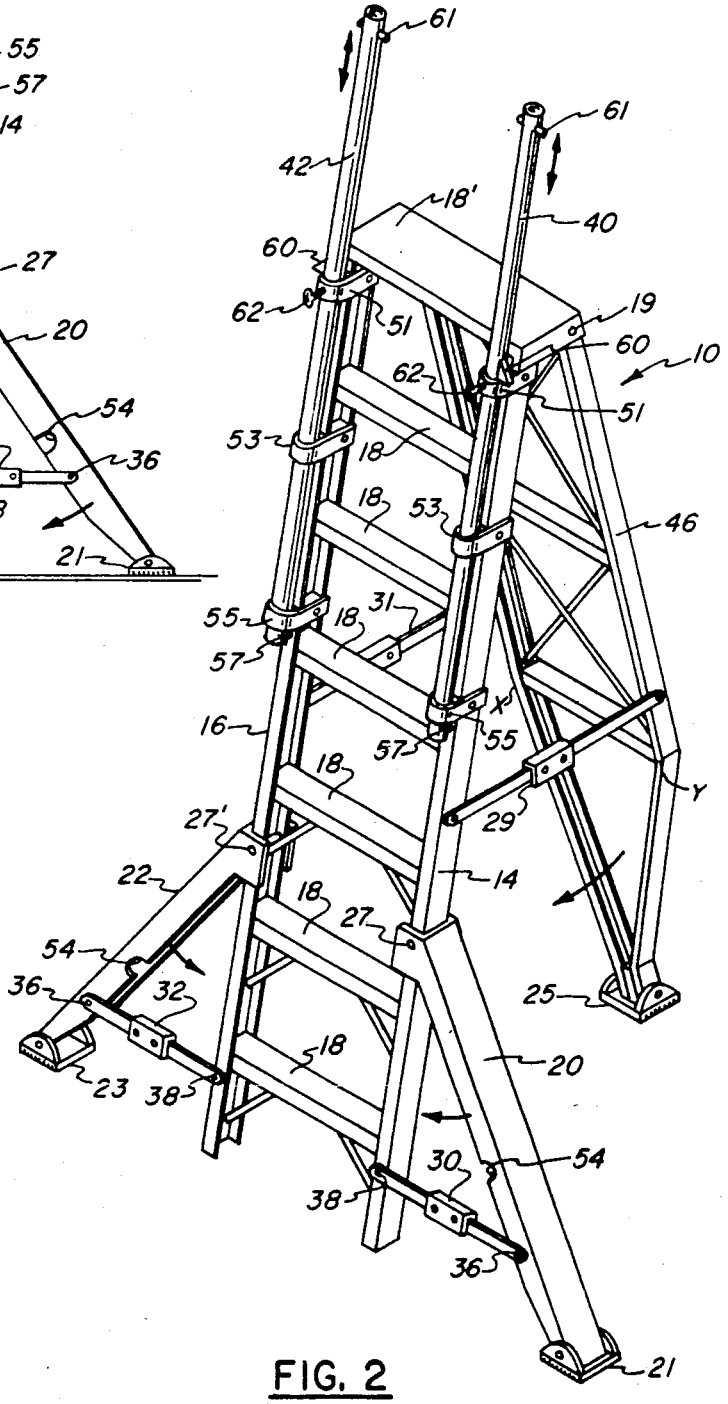
FIG. 2 is a perspective view of the invention.

Referring now to the drawings, FIGS. 1 and 2 show the support designated generally by the numeral 10, in its extended, open, or in-use position. The tripodal support 10 is comprised of an ordinary pair of folding step-ladder parallel non-converging side rails 14 and 16 having a plurality of horizontally disposed and spaced apart rung members 18. Rigidly connected to the uppermost portion of said side rails 14 and 16 is a top rung or top platform 18' as best shown in FIG. 2. Rear support member 46 is hingedly connected at its upper end portion to top rung 18' in a manner typical to folding step ladder design, as, for instance, by using hinge pins 19. Collapsible straps 29 and 31 extend between the side rails 14 and 16 and rear support member 46 in the conventional manner to limit the angle between side rails and rear support member.

Rear support member 46 is comprised of a pair of rails which may be crossed-braced with truss brackets, said rails converging from points X and Y respectively to a common ground engaging foot support means 25, or first ground-engaging support point means. Gusseting may be employed at said points X and Y to strengthen member 46 against buckling under the weight of a heavy climber. The use of a single rear ground-engaging support point at 25 allows the flexibility of placing the ladder 10 so as to avoid ground obstructions.

Figure 3:
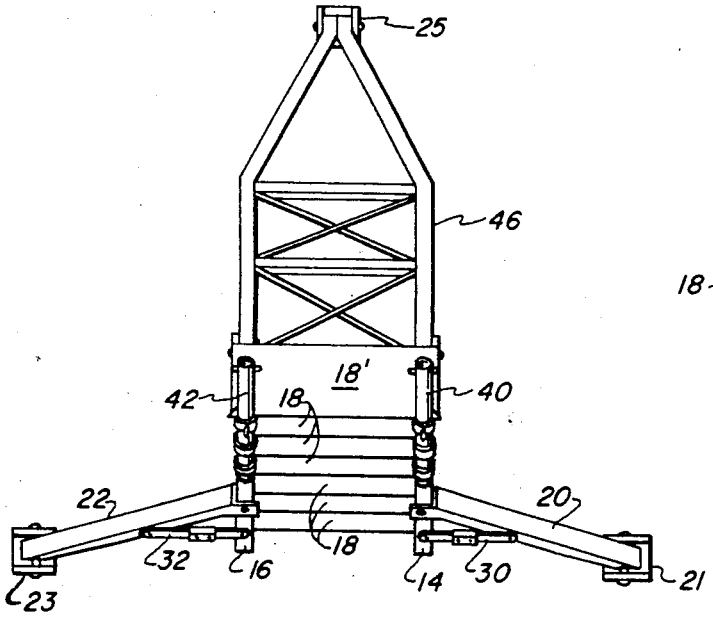
FIG. 3 is a top plan view.
Figure 7:
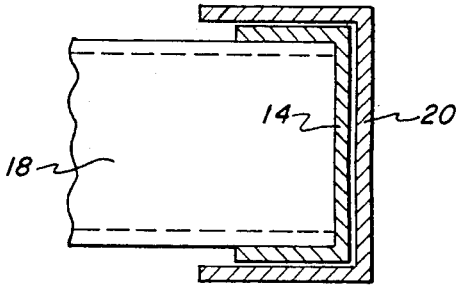
FIG. 7 is a cutaway taken along line 6—6 of FIG. 4.
Figure 4:
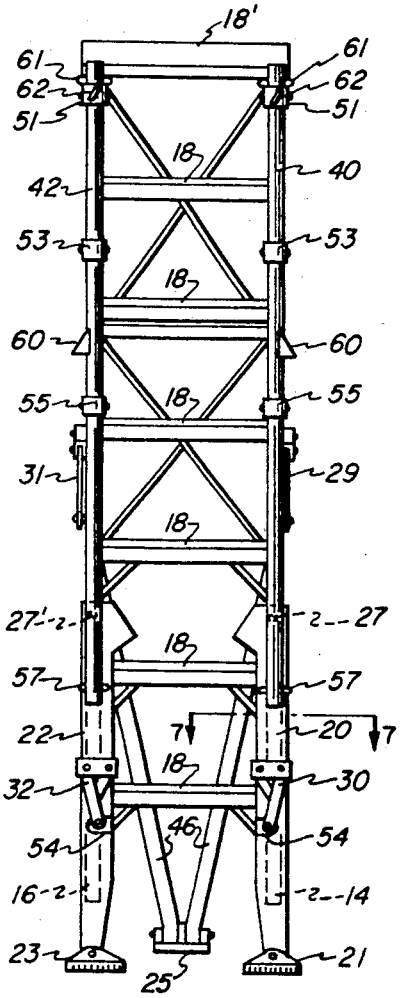
FIG. 4 is a front view showing the invention in its fully retracted state.
Figure 5:
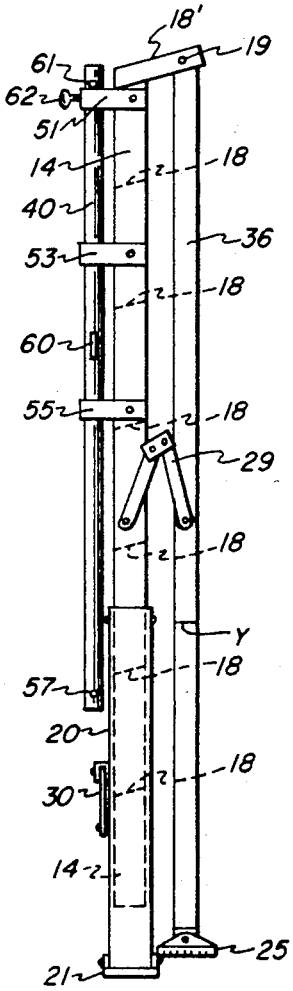
FIG. 5 is a side view showing the invention in its fully retracted state.

Hingedly connected to each side rail at pins 27 and 27' are swingable lateral support legs or outriggers 20 and 22. In order to optimize the stability of the invention, the lowermost ends of outrigger legs 20 and 22 can be swung outward, limited by collapsible straps 30 and 32 respectively which are pivotally connected between side rails 14 and 16 and outriggers 20 and 22, respectively, by pins 36 and 38. When so arranged the ground support means 21 and 23, or second and third ground-engaging support point means, contact the gound at points equidistant from each other and from rear support means 25, said support means thereby forming an equilateral triangle when viewed from above, as shown in FIG. 3. In the preferred embodiment, the distance from support point 21 to support point 23 is sixty percent of the height of the ladder.

Figure 6:
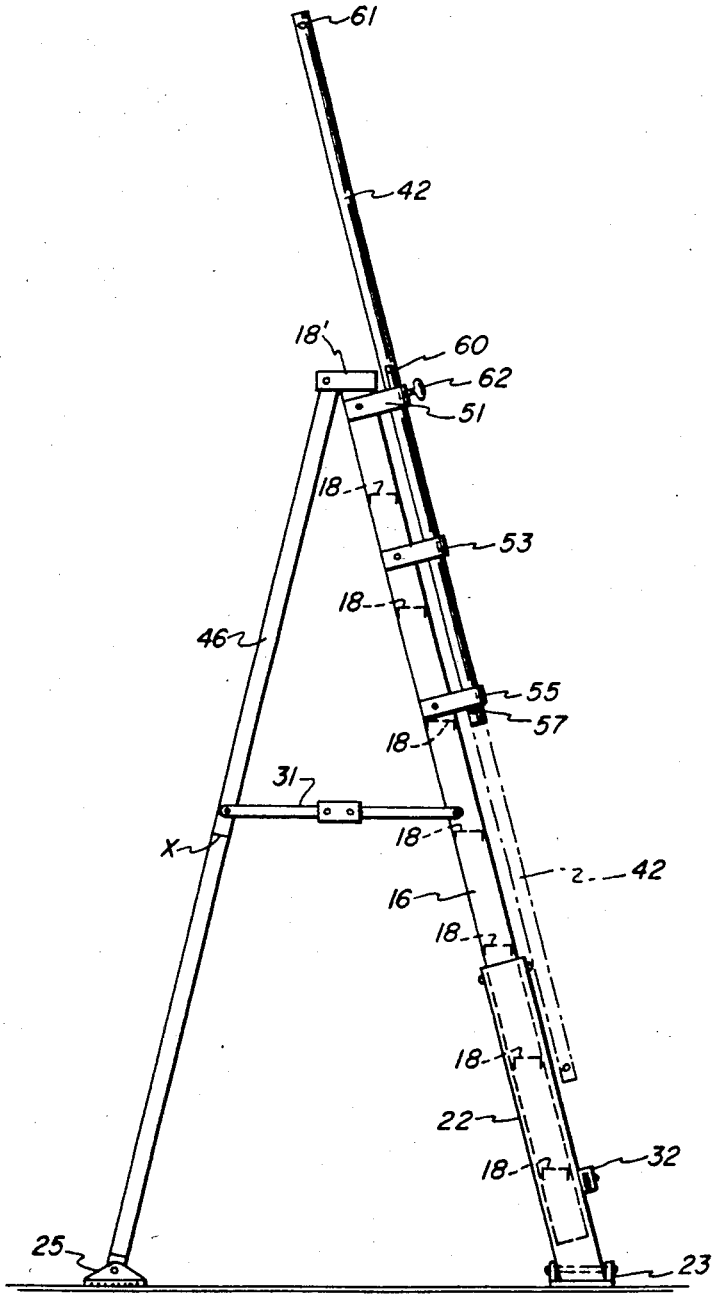
FIG. 6 is a side view showing the invention with the safety hand rails and the support legs in the extended position.

Outriggers 20 and 22 are U-shaped in cross-section. In order to facilitate transport and storage of the invention, outriggers 20 and 22 are collapsible into overlapping engagement with side rails 14 and 16 respectively, as seen in FIG. 6. Notches 54 are provided in the front facing portion of the outriggers 20 and 22 to allow clearance around pins 38 when said outriggers are swung into overlapping engagement with the side rails.

Straps 30 and 32 should preferably be spaced apart from side rails 14 and 16 at the point of connection of 14 with 30 and 16 with 32 to allow for nested overlapping interconnection of side rails with outrigger on each side of the invention. Clamping or other securing means (not shown) may be employed to maintain the outriggers in the closed position when the invention is not being used, and further securing means may be employed to fix the outriggers in the extended position while in use.

It should be noted that the lowermost end portions of the side rails 14 and 16 are kept out of contact with the ground or other support surface when outriggers 20 and 22 are extended, as shown in FIG. 1.

It should also be noted that the ladder should preferably be fabricated of a lightweight metal such as aluminum which exhibits properties of strength and lightweight so that the ladder can be easily handled.

Ground support or engaging means 22,23 and 25 may be fixed foot pads or are preferably hinged foot pads with non-skid ground contact surfaces, connected to the lowermost portion of the outriggers and rear support by means of a hinge pin as seen in FIGS. 1–5, allowing the support means to accommodate surface undulations.

A pair of independently extendable and retractable safety hand rails 40 and 42 are slightly spaced from the front facing surface of side rails 14 and 16 by retaining bracket means 51, 53, and 55, as seen in FIGS. 1–5, in order to clear the front facing surfaces of outriggers 20 and 22, when handrails 40 and 42 are in their retracted positions. Side rails 14 and 16 are parallel when viewed from the front and hence the hand rails 40 and 42 extend upwardly parallel with the side rails 14 and 16 and do not converge into the space to be occupied by a user of the present invention. Preferably the hand rails extend upwardly at least three feet-six inches above top rung 18'. Spring-biased umbrella clip 60 may be employed to retain hand rails 40 and/or 42 in their fully extended position by raising said hand rail(s) so that said clip 60 passes each successive bracket means causing clip 60 to be pressed inwardly and thereafter be released once said clip 60 passes beyond bracket means 55. To lower the hand rail(s), clip 60 is manually depressed and the hand rail(s) lowered while clip 60 is passed through each successive bracket means. Upward extension of hand rails 40 and 42 is limited by retaining pin means 57 connected to the lower end portion of each hand rail, said pin means 57 being sized and shaped so as not to fit through lowermost bracket means 55. Downward retraction of handrails 40 and 42 is limited by retaining pin means 61 connected to the upper portion of each handrail, said pin means 61 being sized and shaped so as not to fit through uppermost bracket means 51. Thumbscrews 62 may be utilized to secure handrails 40 and/or 42 in any intermediate position. The handrails may be alternatively comprised of telescoping elongated members (not shown) with any suitable height adjustment means.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A tripodal support ladder for stable placement on a support surface comprised of:

a pair of spaced apart parallel side rails having at least two horizontally disposed ladder rungs connected therebetween including an upper rung;

a rear support member hingedly connected at its upper end to said upper rung and providing at its lower end a first ground engaging support point means;

said rear support member being moveable between an open position and a closed position and being maintained rigidly in said open position by collapsible strap means pivotably connected between at least one of said side rails and said rear support member;

a pair of extendable and retractable lateral support leg member means hingedly connected one to each of said side rails, said support leg member means hinged near their upper end portions to said side rails and each having a single ground engagement support point means at their lowermosts ends which comprise second and third ground engaging support point means;

each of said lateral support leg member means being rigidly maintainable in a fixed in-use position by way of collapsible strap means pivotably connected between said lateral support leg member means and said side rails;

said lateral support leg member means movable between a fully extended and a fully retracted position, said lateral support leg member means being constrained to swinging motion in a single plane;

said first, second and third ground engaging support point means providing the only ground engagement points of the tripodal support each contacting said support surface at a point equidistant from the other two when said lateral support leg member means are in the fully extended position.

2. The tripodal support of claim 1, wherein said first, second and third ground engaging support point means are fixedly connected ladder foot pad members with ground contact surfaces having a high coefficient of 3. The tripodal support of claim 1, further comprising:

safety hand rail members independently movable between a retracted position and an extended position;

said safety hand rail members being slidably associated and parallel with said side rails, said hand rail members being raisable into a plurality of extended positions wherein a user may grasp said hand rail member while being situated upon said tripodal support to maintain his balance, said hand rail members moving parallel with respect to each other.

4. The tripodal support of claim 3, wherein:

said safety hand rail mmebers are telescopically engaged in sliding relation within a plurality of U-shaped bracket means, said bracket means being connected to said side rails along generally the upper one-third of said side rails;

each said hand rail member further having hand rail height retention means.

5. A tripodal support ladder for stable stationary positioning of a ladder upon a support surface, comprised of:

first and second ladder side rails in spaced relation, each said rail having a respective upper end and a lower end, said lower end of each said rail contacting said support surface at first and second ground engaging points, respectively, an upper horizontal rung disposed between said first and second ladder side rails near the upper ends thereof;

a rear support member having an upper end portion and a lower end portion, said upper end portion connected to said upper horizontal rung, said lower end portion contacting said support surface at a third ground engaging point;

said first, second and third ground engaging points each equally spaced from the other two, the space between any two said ground engaging points being approximately 60 percent of the height of said tripodal support ladder, said first, second and third ground engaging points being the only points capable of making ground contact when said ladder is in use;

said first, second and third ground engaging points form an equilateral triangle when viewed from above;

a climber, when ascending the horizontal rungs, is thereby moved increasingly closer toward being centered vertically above the centroid of said equilateral triangle.

6. A tripodal support ladder as set forth in claim 5, further comprising:

a plurality of lower horizontal ladder rungs disposed between said first and second side rails below said upper horizontal rung to allow for stepping on said rungs as a user climbs said ladder;

said rear support member is hingedly connected to said upper horizontal rung to allow said rear support member to be swung into generally perpendicular facial relation with said lower horizontal rungs whereby said ladder can be collapsed for storage.

7. A tripodal support ladder as set forth in claim 6, wherein:

said lower end of said first rail is comprised of a first rail end portion and an outrigger support arm whose lower end is outwardly swingable and thereby movable from a first position in closely spaced nested association with said first rail to a second position laterally extending from a point of hinged connection on said first rail and terminating with said first ground engaging point;

said lower end of said second rail being a mirror image of the lower end of said first rail.

* * * * *